United States Patent [19]

Knight

[11] 4,089,495

[45] May 16, 1978

[54] PHASE-CONTROLLED TRACK CIRCUIT RECEIVER

[75] Inventor: Alan Clifford Knight, Munchingen, Germany

[73] Assignee: International Standard Electric Corporation, New York, N.Y.

[21] Appl. No.: 795,994

[22] Filed: May 11, 1977

[30] Foreign Application Priority Data

May 28, 1976 Germany ..... 2623967

[51] Int. Cl.[2] ..... B61L 21/00

[52] U.S. Cl. ..... 246/34 R; 325/346; 325/419

[58] Field of Search ..... 178/69.1, 88; 246/34 R, 246/34 CT, 122 R; 318/608; 324/82, 83 B, 83 FE; 325/346, 351, 419–421, 320; 328/133, 155; 329/50; 340/147 SY, 170

[56] References Cited

U.S. PATENT DOCUMENTS

| | | | |
|---|---|---|---|
| 3,238,459 | 3/1966 | Landee | 340/170 X |
| 3,610,920 | 10/1971 | Frielinghaus | 246/122 R X |
| 3,714,595 | 1/1973 | Denenberg et al. | 325/346 X |

*Primary Examiner*—Stephen G. Kunin

*Attorney, Agent, or Firm*—John T. O'Halloran; Jeffrey P. Morris

[57] ABSTRACT

A track circuit receiver with a synchronous detector is provided wherein the phase of the reference voltage is caused to automatically follow that of the input voltage, so that there can be no reduction in output signal level as a result of phase differences between input voltage and reference voltage. Fail-safe operation is achieved by inverting the phase of the reference voltage and monitoring the rate of phase change at the output. The track circuit receiver of the present invention additionally utilizes simplified circuitry to achieve the foregoing.

3 Claims, 2 Drawing Figures

PHASE-CONTROLLED TRACK CIRCUIT RECEIVER

BACKGROUND OF THE INVENTION

The present invention relates to a fail-safe track circuit receiver comprising at least one synchronous detector, at least one low-pass filter, and following threshold switches.

German Offenlegungsschrift (DT-OS) No. 2,217,133 describes a receiver for evaluating track voltages in track circuits for track-clear signalling in railway systems which contains several synchronous detectors followed by low-pass filters whose output voltages actuate track relays via switching stages.

The reference voltages necessary for phase demodulation may have predetermined phase differences in order to obtain a "clear" indication of the track section in a given range of the phase position of the track voltage to be evaluated. This circuit permits fail-safe track-clear signalling as long as the phase of the received ac voltage is fixed relative to that of the ac reference voltage. Since the phase of the ac reference voltage is preset in this case, it cannot follow the received ac voltage, whose phase varies with weather conditions, and this results in phase shifts between the two voltages which lead to a decrease in the level of the dc voltage signals at the outputs of the low-pass filters. This decrease is possible mainly in track circuits of great length and in insulated-rail-joint-free track circuits, and results in false indications of track conditions and, thus, in obstructions to rail traffic.

SUMMARY OF THE INVENTION

The object of the invention is to provide a fail-safe track circuit receiver which is immune to phase differences between the received ac voltage and the ac reference voltage, is driftless, does not require a large amount of circuitry, and still meets the selectivity and sensitivity requirements placed on a track circuit receiver to be used, for example, in insulated-rail-joint-free track circuits employing several, closely adjacent frequencies.

The track circuit receiver according to the invention is characterized in that it has an automatic phase control which holds the ac reference voltage necessary for synchronous detection in given phase positions, i.e. relationship, with respect to the received ac voltage, and that a continuous functional check is performed by shifting said given phase positions.

This ensures that the received ac voltage and the ac reference voltage have a nearly stable phase relationship to one another, and prevents any decrease in the output voltage of the low-pass filter due to phase departures of the received ac voltage. In addition, the whole receiver circuit is constantly checked for its operating ability, and component failures are immediately detected. The need for several expensive synchronous detectors in parallel is thus eliminated.

An improvement of the track circuit receiver according to the invention is characterized in that the automatic phase control is digital in design and consists of a first frequency divider, a second frequency divider, a clock-pulse generator, and an exclusive-0R gate for controlling the second frequency divider, that the first frequency divider derives the ac reference voltage from a transmitter divider voltage of $2^n$ times the frequency of the received ac voltage by dividing said frequency down to the frequency of the received ac voltage, and that, in addition, a phase shift by a given angular amount is effected step by step in the rhythm, i.e., synchronization of a first control frequency derived by the second frequency divider from the frequency of the clock-pulse generator, and that the transmission of the first control frequency to the first frequency divider is prevented when the exclusive-0R gate controlling the second frequency divider determines non-equivalence of the output voltages of the threshold switches.

This permits the phase of the ac reference voltage to be stepped on automatically to a desired position relative to the received voltage, with freedom from drift being achieved by a digital design of the circuit.

A further improvement of the track circuit receiver according to the invention is characterized in that the shifting of said given phase positions is performed by an inverter which is enabled and disabled in the rhythm of a second control frequency derived by a third frequency divider from the basic frequency of the clock-pulse generator, and that, for supervising the shifting at the outputs of the threshold switches, each of said threshold switches is followed by a monostable multivibrator which operates a track relay via a rectifier only when the output voltage of the associated threshold switch pulsates at the rate of phase change.

A preferred embodiment of the track circuit receiver according to the invention will now be explained with reference to the accompanying drawings, in which:

DESCRIPTION OF THE PREFERRED EMBODIMENT

A housing G contains: a transmitter S, two track circuit receivers E, and a relay group RG which supervises track relays controlled by the track circuit receivers E for non-equivalence and applies a "clear" or "occupied" message to a trackside cable SK or to a console line ST. As the input voltage for the track circuit receivers E, the voltage drop across terminating impedances Z1 and Z2 of the track circuit GL are used, which are applied to the track circuit receivers E over cables. Reference voltages are applied to the track circuit receivers from the transmitter S over connecting lines V. If the track circuit is short-circuited, e.g. by a vehicle axis, the received voltages will drop depending on the place of the short circuit, and an "occupied" message will be transmitted.

Figure 1:
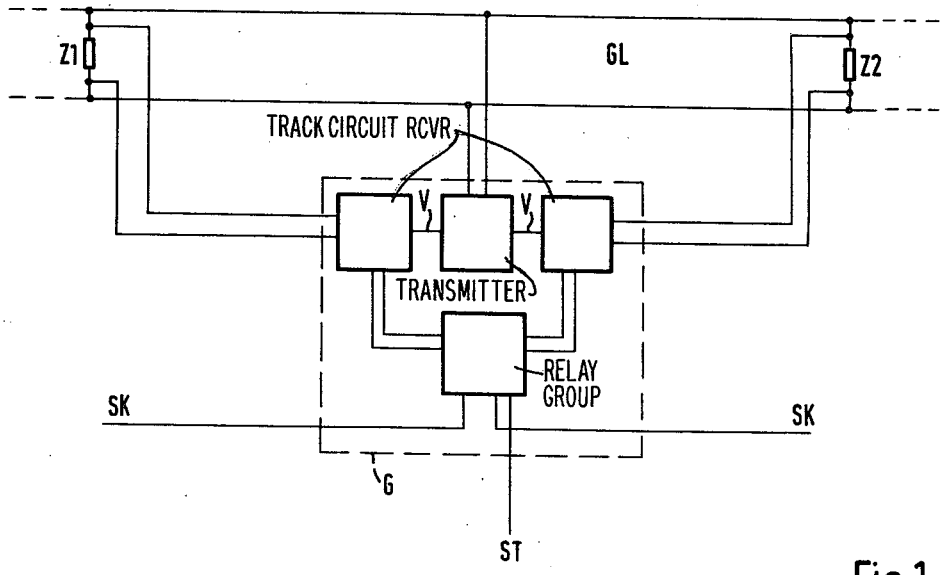
FIG. 1 shows a track circuit.
Figure 2:
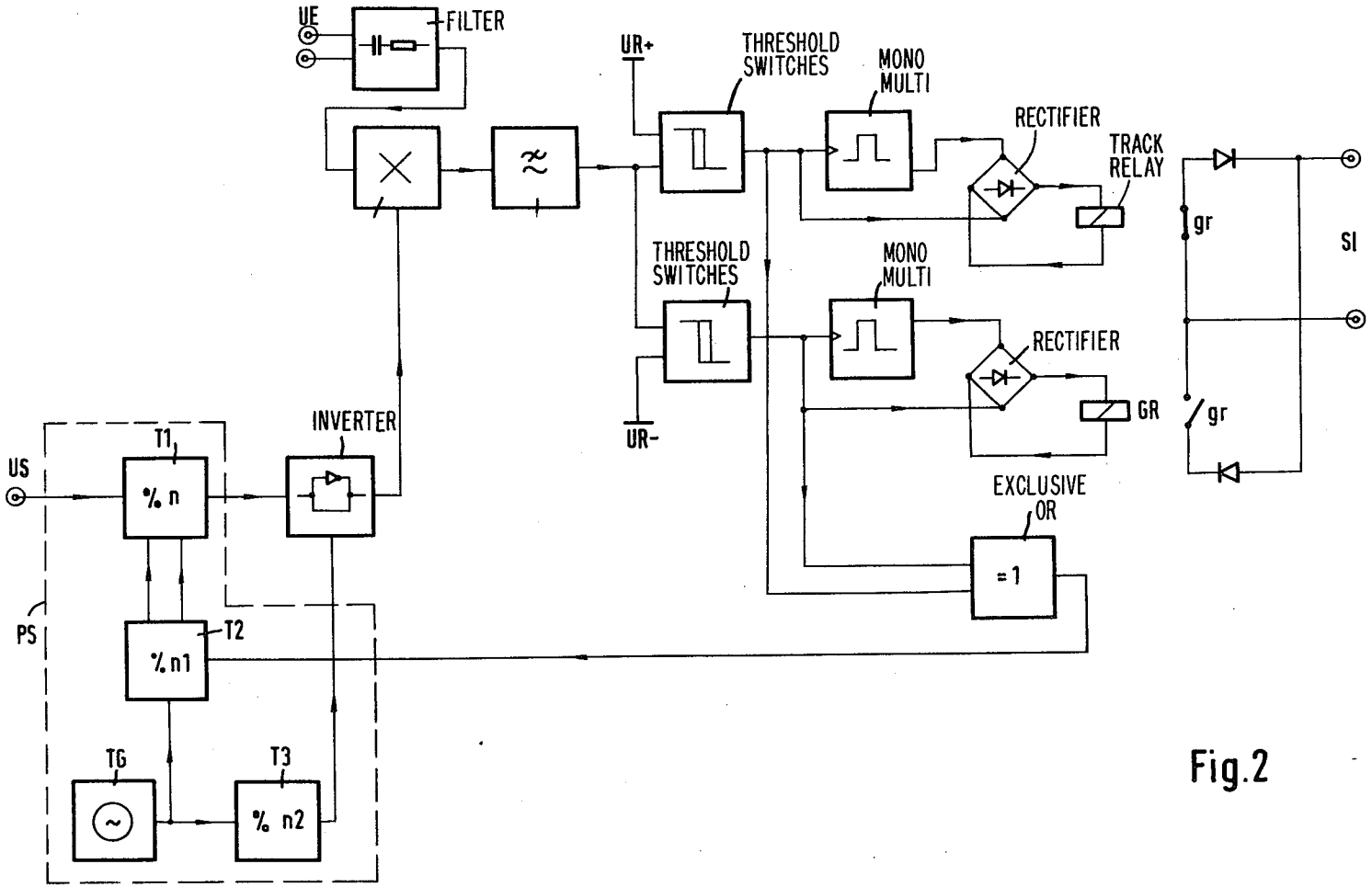
FIG. 2 shows the circuit of a track circuit receiver according to the invention.

FIG. 2 shows the circuit of an embodiment of a track circuit receiver according to the invention.

A synchronous detector SD, preferably a multiplier, links the signal received via a filter circuit F with a reference signal of the same frequency. A following low-pass filter TP largely suppresses mixed and interfering frequencies and passes almost only the dc component of the output voltage of the synchronous detector SD. The output of the low-pass filter therefore provides a dc voltage which is proportional to the received ac voltage, but also depends on the instantaneous phase of the ac reference voltage relative to the received ac voltage. If a voltage $U=U_o$ appears at the output of the low-pass filter at a 0° phase shift, it will decrease with increasing phase shift and reach the value $U=O$ at a 90° phase shift, and the value $U=U_o$ at a 180° phase shift. As the phase shift continues to increase, U again rises via U=O at 270° to $U=U_o$ at 360°. To ensure that this dependence of the output voltage of the low-pass filter TP on the phase relationship of the ac reference voltage to the received ac voltage has no effect, and that the dc output voltage of the low-pass filter always assumes maximum values at maximum input signal level, the phase of the ac reference voltage is caused, in a phase-shift circuit PS, to always follow that of the received ac voltage in such a way that the phase difference between the two voltages is nearly 0° or nearly 180°. In addition, a controllable inverter I changes the phase of the ac reference voltage at regular intervals between 0° and 180°, so the output of the low-pass filter provides an ac voltage whose frequency is equal to the rate of phase change (shift frequency).

Two threshold switches SW compare the output voltage of the low-pass filter with a positive reference voltage (plus UR) and a negative reference voltage (minus UR) and switch when these reference voltages are exceeded. Since one threshold switch switches only at a positive output voltage of the low-pass filter, and the other only at a negative output voltage, only one threshold switch can be in the "on" state at maximum input level. This condition of non-equivalence of the output voltages of the threshold switches is a criterion for an unoccupied track circuit GL and additionally serves to control the phase-shift circuit PS.

A second criterion which must also be fulfilled if a track-clear message is to be transmitted is the appearance of the shift frequency at the outputs of the threshold switches. Each of two following monostable multivibrators MF with a delay in the order of one-half period of the shift frequency controls a track relay GR via a rectifier GL in the proper manner only if it is always reset as a result of the pulsating voltage at the output of the respective threshold switches. Thus a component failure automatically results in an "occupied" message, no matter whether it becomes apparent by the non-appearance of a pulsating voltage at a threshold switch output or by an increase in frequency.

The phase-shift circuit PS causes the phase of the ac reference voltage to follow that of the received ac voltage. It contains a first frequency divider T1 which derives the ac reference voltage from an ac voltage coming from the frequency divider of the transmitter and having a frequency $2^n$ times that of the received frequency, and additionally causes the phase of the ac reference voltage to be shifted step by step at a first control frequency. The reference voltage is then applied to the synchronous detector SD through the inverter I. The first control frequency is derived in a second frequency divider T2 from the basic frequency of a clock-pulse generator TG, and an exclusive-OR gate EO connected to one control input of the second frequency divider prevents the delivery of this first control frequency when determining non-equivalence of the output voltages of the threshold switches. The clock-pulse generator TG also supplies a third frequency divider T3 which provides the control signal for the inverter I.

I claim:

1. A fail safe track circuit receiver having an output signal level which is substantially independent of phase variation of an input ac voltage, comprising:
   - an ac reference voltage;
   - means for providing automatic phase control for maintaining a given phase relationship between said input ac voltage and said ac reference voltage;
   - means for providing synchronous detection of said input ac voltage having said given phase relationship; and
   - means for shifting said given phase relationship for performing a continuous functional check.

2. A fail safe track circuit receiver having an output signal level which is substantially independent of phase variation of an input ac voltage, comprising:
   - an ac reference voltage;
   - means for providing a digital automatic phase control for maintaining a given phase relationship between said input ac voltage and said ac reference voltage wherein said phase control includes:
   - first frequency divider means;
   - second frequency divider means;
   - clock-pulse generator means;
   - exclusive-OR gate means for controlling said second frequency divider means such that said first frequency divider means derives said ac reference voltage from a transmitter divider voltage of $2^n$ times the frequency of said input ac voltages by dividing said frequency down to the frequency of said input ac voltage, and wherein a phase shift by a given angular amount is effected step by step in synchronization with a first control frequency derived by said second frequency divider from the frequency of said clock-pulse generator, and wherein the transmission of said first control frequency to said first frequency divider is prevented when said exclusive-OR gate controlling said frequency divider determines non-equivalence of the output voltages of threshold switches having said reference voltage as the threshold voltage thereof;
   - means for providing synchronous detection of said input ac voltage having said given phase relationship; and
   - means for shifting said given phase relationship for performing a continuous functional check.

3. A track circuit receiver according to claim 2, wherein the shifting of said given phase relationship is performed by:
   - inverter means enabled and disabled in synchronism with a second control frequency derived by a third frequency divider means from the basic frequency of said clock-pulse generator, for supervising the shifting at the outputs of said threshold switches, and wherein each of said threshold switches is followed by a monostable multivibrator means which operates a track relay means through a rectifier means only when the output voltage of the associated threshold switch pulsates at the rate of phase change.

* * * * *